United States Patent [19]

Lepetri

[11] 4,062,522

[45] Dec. 13, 1977

[54] PICKET FENCE WITH REMOVABLE INTERMEDIATE FLATS

[76] Inventor: Joseph Lepetri, 54 Fernwood Ave., Oakdale, N.Y. 11769

[21] Appl. No.: 759,453

[22] Filed: Jan. 14, 1977

[51] Int. Cl.[2] ..... E04H 17/00

[52] U.S. Cl. ..... 256/1; 256/22

[58] Field of Search ..... 256/34, 24, 21, 22, 256/19, 25, 73, 1, 12.5, DIG. 5, 66, 67, 72

[56] References Cited

U.S. PATENT DOCUMENTS

| | | | |
|---|---|---|---|
| 2,545,845 | 3/1951 | DuBatto et al. | 256/19 |
| 3,122,355 | 2/1964 | Richardson | 256/21 |
| 3,700,213 | 10/1972 | Blease | 256/19 |

FOREIGN PATENT DOCUMENTS

| | | | |
|---|---|---|---|
| 275,220 | 8/1964 | Australia | 256/24 |
| 451,371 | 8/1936 | United Kingdom | 256/73 |
| 1,248,237 | 9/1971 | United Kingdom | 256/24 |

*Primary Examiner*—Andrew V. Kundrat

[57] ABSTRACT

A picket fence arrangement in which vertically positioned picket members are provided with longitudinal grooves or slots along their lengthwise edges. Metal slats or strips are inserted into oppositely facing and neighboring grooves. The slat inserts cover the gaps separating the vertically standing picket members, so that the fence serves to peserve privacy of the area about which the fence is positioned. The pickets are held in vertically standing position by means of cross bars, and the metal insert slats may have a substantially slight curvature in the cross-sectional plane.

9 Claims, 5 Drawing Figures

PICKET FENCE WITH REMOVABLE INTERMEDIATE FLATS

BACKGROUND OF THE INVENTION

In the application of fences to private areas and swimming pools, for example, it is desirable to install fences which are flexible from the viewpoint that they may be adapted so as to prevent visual sight through the fence, whenever deemed appropriate. At the same time, it is desirable to be able to adapt the fence so that it may be opened to the extent that it is possible to see through the fence. It is also desirable that the fence be arranged so as to allow flexibility in assembling and installing in an irregular area.

Accordingly, it is an object of the present invention to provide a fence in which supporting pickets spaced from each other may be adapted so as to close the spaces from the viewpoint of visibility therethrough.

Another object of the present invention is to provide a flexible arrangement of the foregoing character in which the spaces between pickets may be opened or closed at will.

A further object of the present invention is to provide a fence arrangement, as described, which may be economically fabricated and is simple in construction.

A still further object of the present invention is to provide a picket fence which may be readily maintained in service and which has a substantially long service life.

SUMMARY OF THE INVENTION

The objects of the present invention are achieved by providing a picket fence in which vertically standing picket members are spaced from each other and are held in place by means of cross bars. Each of the vertically standing picket members is provided with longitudinal grooves along the two lengthwise edges.

When closing the fence against visibility therethrough, metal slats are inserted in oppositely facing and neighboring grooves, so that the slats cover the spaces or gaps between the neighboring grooves or neighboring picket members. The metal slats or strips may be in the form of venetian blind elements and have a substantially slight curvature imparted to them for purposes of providing strength and flexibility.

To open the face so that it is possible to see therethrough, the metal slats are removed from the grooves.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

DESCRIPTION OF THE PREFERRED EMBODIMENTS

Figure 1:
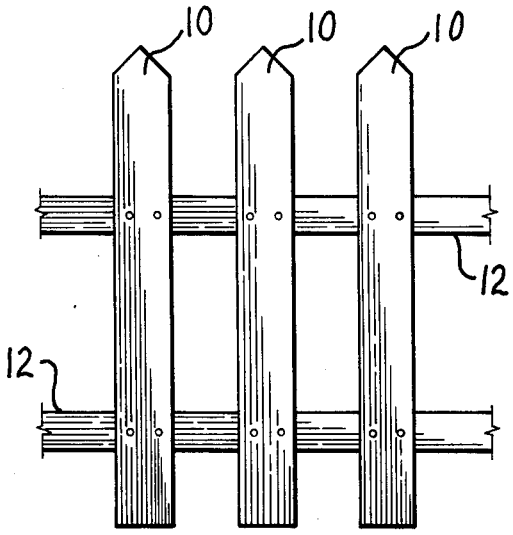
FIG. 1 is an elevational front view of a portion of the picket fence when installed in accordance with the present invention.
Figure 2:
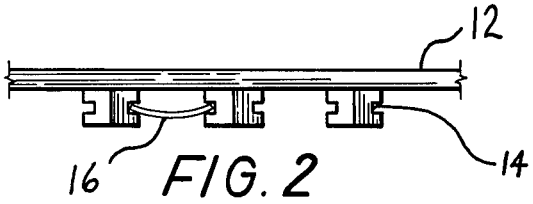
FIG. 2 is a top view of the portion of the picket fence shown in FIG. 1.
Figure 3:
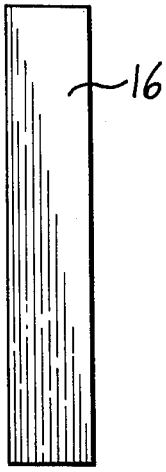
FIG. 3 is an elevational front view of metal slats inserted in the gaps between vertically standing picket members shown in FIG. 1.
Figure 4:
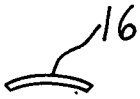
FIG. 4 is a top view of the slat shown in FIG. 3.

Referring to the drawings, the picket fence in accordance with the present invention has vertically standing picket members 10 spaced from each other. Cross bars 12 support the vertically standing picket members 10, and maintain a predetermined spacing between these members.

Each member 10 is provided with grooves 14 which run along the edges of the member 10 in lengthwise direction.

A metal slat or strip 16 may be inserted between neighboring grooves that are facing oppositely to each other. The slats 16 serve to close the gaps or spaces between picket members 10 when installed in place and assembled wth the cross bars 12.

The metal slats or strips 16 may be in the form of thin metallic strips of spring-like material such as venetian blind strips. At the same time, the metal slats or strips 16 have imparted to them a substantially slight curvature. This curvature serves to add structural strength to the slat or strip, and allows the strip to retain its originally intended shape in the event that they become bent, for example, during use or assembly. Such spring-like material, furthermore, provides the strips with flexibility, so that they may be inserted easily lin place.

When the fence is to be used only for the purpose of marking off or defining a particular area, then the metal slats 16 may be omitted from their places between the vertically standing picket members 10. When, on the other hand, the fence is to be used for preserving privacy of the area that is fenced, then the metal elements or slats 16 are inserted into place in their respective grooves of oppositely adjacent members 10. When in place, the metal slats 16 serve to cover against visibility any of the spaces that are present in the fence.

The metal slats 16, furthermore, permit considerable flexibility in positioning of the fence along areas having an irregular outline. The shape and spring-like character of the metal slats 16 allow the fence to be used, for example, along border lines or area perimeters having sharply circular-shaped curvatures, for example. For this purpose, the cross bars 12 may also be substantially flexible members which may be adapted to the shape of the perimeter of the area to be fenced.

Figure 5:
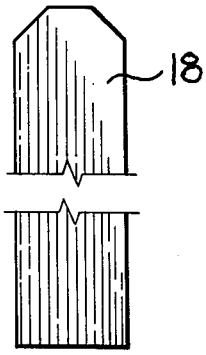
FIG. 5 is a partial front view of a picket member with a top shape differing from that shown in FIG. 1.

The top portions of the picket members 10 may have the triangular-shape, as shown in FIG. 1, or they may be of substantially other shapes as shown in FIG. 5, for example. The width of the picket members may, for example, be 4 to 6 inches, and their height may for example be 4 to 6 feet. The grooves or slots 14 along the edges of the picket members 10, may, for example, be 3/16 inch wide.

The picket members 10 and cross bars 12 may be made of wood, metal or plastic material, for example.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A picket fence comprising in combination: picket members spaced from each other and having lengthwise edges and including cross-bar means interconnecting said picket members at spaced intervals and supporting said picket members; groove means along the opposite lengthwise edges of each of said picket members; single-piece strip-shaped elements insertable in neighboring oppositely-facing grooves, the spaces between said neighboring grooves corresponding substantially to the spacing between picket members, said spacing between adjacent picket members corresponding substantially to the width of a picket member, said strip-shaped elements being of a width to cover said spaces when inserted in place in said neighboring grooves; the lengthwise edges of said strip-shaped elements being inserted only in said lengthwise neighboring grooves for covering said spaces between picket members, said strip-shaped elements being substantially parallel to said picket members and being free of contact with said cross-members interconnecting said picket members, said strip-shaped elements being selectively inserted into said groove means for preventing vision through said fence and said strip-shaped elements being selectively removable from said groove means to permit vision through said fence.

2. The picket fence as defined in claim 1 wherein said strip-shaped elements have a substantially curved cross-section.

3. The picket fence as defined in claim 1 wherein said strip-shaped elements are comprised of metal.

4. The picket fence as defined in claim 1 wherein said groove means have walls forming a U-shape with rectangular-shaped side surfaces.

5. The picket fence as defined in claim 1 wherein said strip-shaped elements are of plastic material.

6. The picket fence as defined in claim 1 wherein said picket members are comprised of wood.

7. The picket fence as defined in claim 1 wherein said picket members are comprised of metal.

8. The picket fence as defined in claim 1 wherein said picket members are comprised of plastic.

9. The picket fence as defined in claim 1 said strip-shaped elements having a substantially curved cross-section, said groove means having walls forming a U-shape with rectangular-shaped side surfaces, said strip-shaped elements being comprised of spring-like metal.

* * * * *